US006848988B2

(12) United States Patent
Kurosawa

(10) Patent No.: US 6,848,988 B2
(45) Date of Patent: Feb. 1, 2005

(54) SMALL COIN HOPPER

(75) Inventor: Motoharu Kurosawa, Iwatsuki (JP)

(73) Assignee: Asahi Seiko Co., Ltd., Tokyo (JP)

( * ) Notice: Subject to any disclaimer, the term of this patent is extended or adjusted under 35 U.S.C. 154(b) by 0 days.

(21) Appl. No.: 10/423,446

(22) Filed: Apr. 25, 2003

(65) Prior Publication Data

US 2004/0005852 A1 Jan. 8, 2004

Related U.S. Application Data

(62) Division of application No. 09/982,706, filed on Oct. 18, 2001, now Pat. No. 6,695,690.

(30) Foreign Application Priority Data

Oct. 20, 2000 (JP) ..... 2000-321537

(51) Int. Cl.[7] ..... G07D 1/00
(52) U.S. Cl. ..... 453/33
(58) Field of Search ..... 453/53, 33, 49

(56) References Cited

U.S. PATENT DOCUMENTS 4,881,919 A 11/1989 Dabrowski
4,997,405 A * 3/1991 Dabrowski ..... 453/57
5,017,176 A * 5/1991 Swierczek ..... 453/49
5,098,339 A 3/1992 Dabrowski
5,316,517 A 5/1994 Chiba et al.
5,330,384 A * 7/1994 Shapley et al. ..... 453/17
5,607,352 A 3/1997 Tani
6,273,809 B1 8/2001 Bell et al.

FOREIGN PATENT DOCUMENTS

EP 0044 640 A2 1/1982
EP 0 831 430 A2 3/1998
JP 3-130893 6/1991

* cited by examiner

*Primary Examiner*—Donald P. Walsh
*Assistant Examiner*—Mark J. Beauchaine
(74) *Attorney, Agent, or Firm*—McGlew and Tuttle, P.C.

(57) ABSTRACT

The size of a coin hopper on the whole is reduced, particularly providing fewer coin holes for discharging and accepting a coin. A container or coin hopper head generally of a cylindrical form stores a plurality of coins in a bulk condition. A disk is freely rotatably arranged within the bottom of this head, for releasing said coins. The disk has a one coin passage opening for accepting and releasing said coins.

9 Claims, 12 Drawing Sheets

FIG. 4A
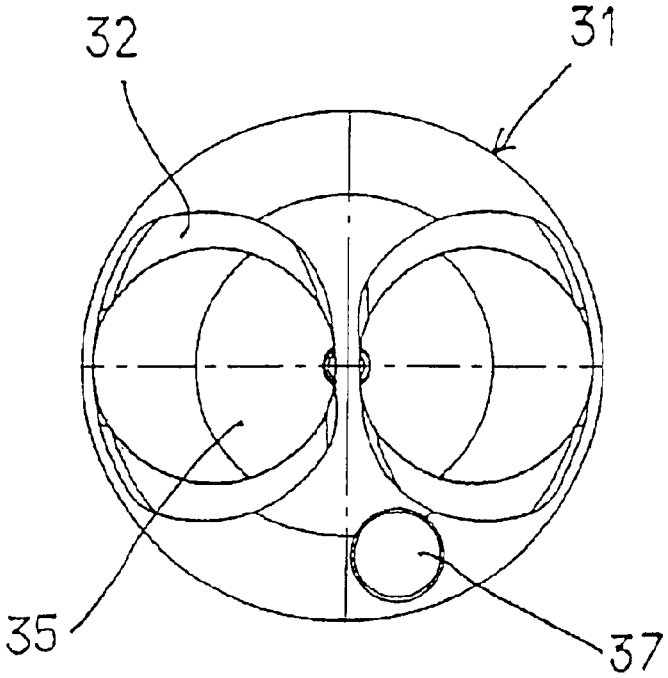
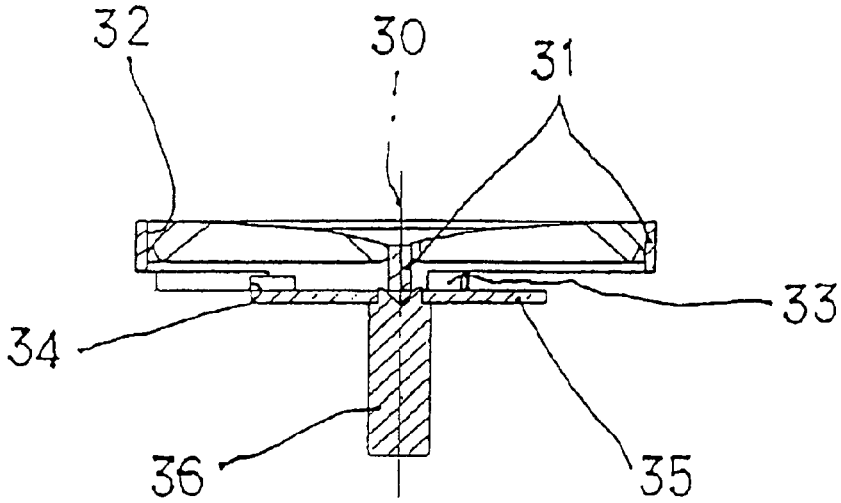
FIG. 4B

SMALL COIN HOPPER

RELATED APPLICATION

This is a Divisional of application Ser. No. 09/982,706 filed Oct. 18, 2001, now U.S. Pat. No. 6,695,690 and the entire disclosure of this prior application is considered to be part of the disclosure of the accompanying application and is hereby incorporated by reference therein.

FIELD OF THE INVENTION

This invention relates generally to coin hopper equipment for storing a plurality of coins in a loose condition, and for sending out or issuing coins one by one. The invention relates more particularly to a coin hopper that is used for vending machines including token and medal and machines as well as coin currency based machines and money changers with a very small coin hopper which is suitable for change equipment in changers used in retail stores, gamming establishments and so on. The term "coin" in this specification is used to refer to coins which are currency as well as small disk medals and tokens used in games.

BACKGROUND OF THE INVENTION

A small coin hopper equipment is disclosed in Japanese Patent Application 10-333332 by this applicant. The Japanese Patent Application 10-333332 is laid-open in public as Japanese Patent Disclosure 2000-132723. FIG. 10 shows a perspective view which is disclosed in Japanese Patent Application 10-333332. FIG. 11 shows a perspective view of the coin hopper of FIG. 10 with the upper part thereof removed. This small coin hopper has an electric motor 15. Motor 15 has a driving shaft with a projecting end located directed downwardly. The small coin hopper has a primary gear (not shown) which is fixed on the projecting end of the driving shaft. The coin hopper also has a head 45 for storing a plurality of coins and a disk 41 within the bottom of head 45, for releasing the coins one by one. In addition, the coin hopper has a second gear 25 for rotating the disk 41. Further, the coin hopper has gears 17 and 23 forming a gear train for coupling the second gear 25 and said primary gear, and so on.

In the conventional coin hopper as described above, a level base board 31 was used for miniaturizing the overall construction. The hopper used an electric motor placed at the corner of base board 31. The gear train is placed under the base board 31. However, in the prior configuration there was a limit to the degree of miniaturization of the overall coin hopper.

SUMMARY AND OBJECTS OF THE INVENTION

It is an object of the invention to further miniaturize a coin hopper and particularly to decrease the size of the coin hopper as a whole.

It is a further object of the invention to possibly decrease the number of open holes for accepting and discharging coins.

According to the invention a coin hopper is provided with at least: a head or container of a generally cylindrical form, for storing a plurality of coins in a bulk condition. A disk is disposed freely rotatably arranged within the bottom of this head, for releasing the coins. An opening or open hole is provided in the disk, for accepting and releasing said coins. The open hole has two opening passages formed around or adjacent to the rotation axis of the disk.

The two open holes are closed with respect to each other. Particularly, the two open holes have wall defining side surfaces separating the two open holes from each other.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 4A is a plan view of a disk arrangement of the embodiment according to FIG. 1;

FIG. 4B is a sectional view of the disk arrangement of the embodiment according to FIG. 1;

DESCRIPTION OF THE PREFERRED EMBODIMENTS

Figure 1:
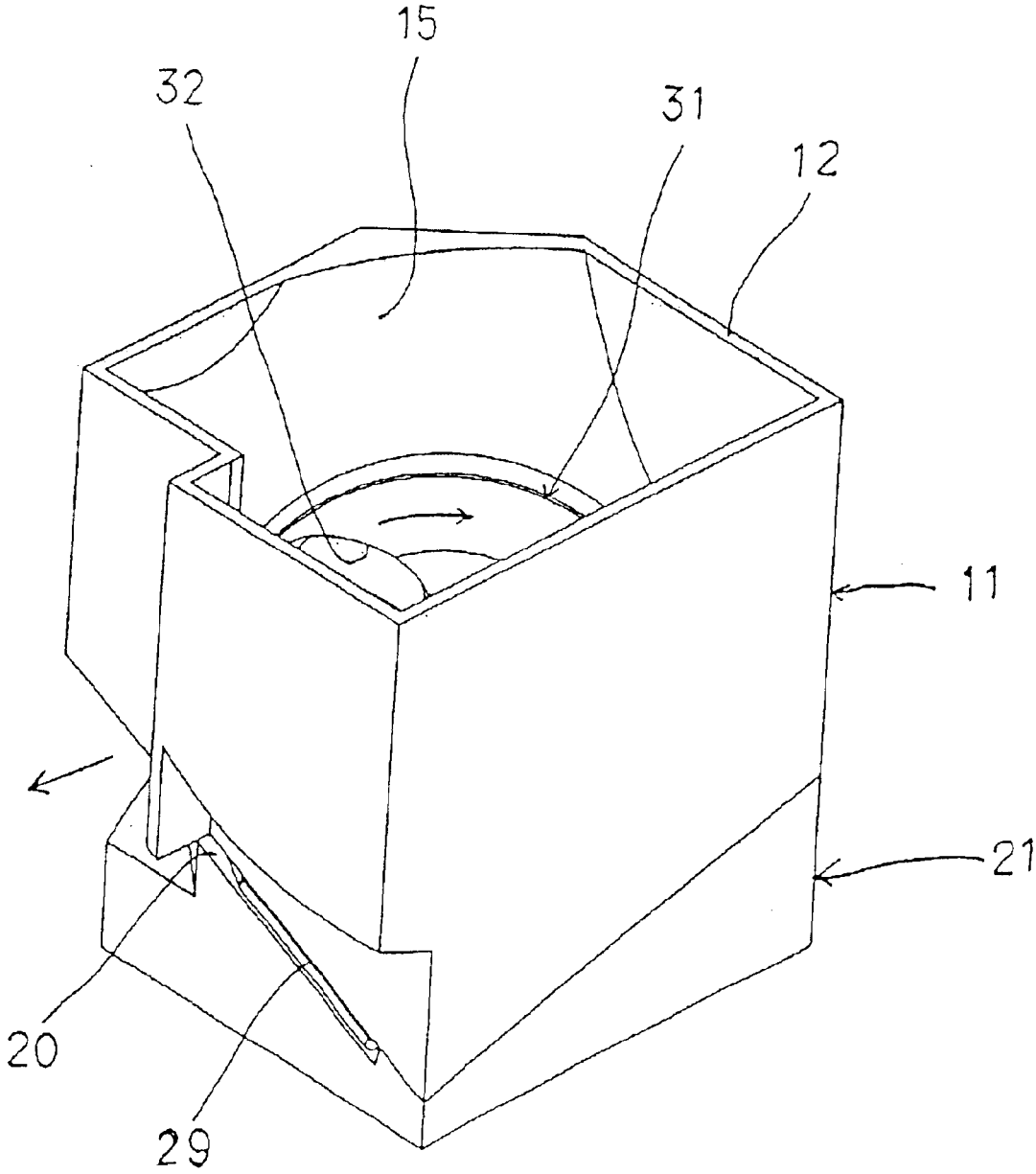
FIG. 1 is a perspective view which summarily shows an embodiment according to this invention.

Referring to the drawings in particular, a small coin hopper which is a practical example according to this invention is shown in FIG. 1. As a whole, the small coin hopper has a cube like shape. The small coin hopper has a container or head 11 of a large angle cylindrical form. The container or head 11 is for storing a plurality of coins in a loose condition. The container or head 11 is made of synthetic resin molded to provide the shape. The container or head 11 has an upper edge 12 formed at a level. The entire bottom surface 13 of the container or head 11 is formed extending obliquely relative to the level of the upper edge 12 and is round in shape (see FIG. 2).

Figure 2:
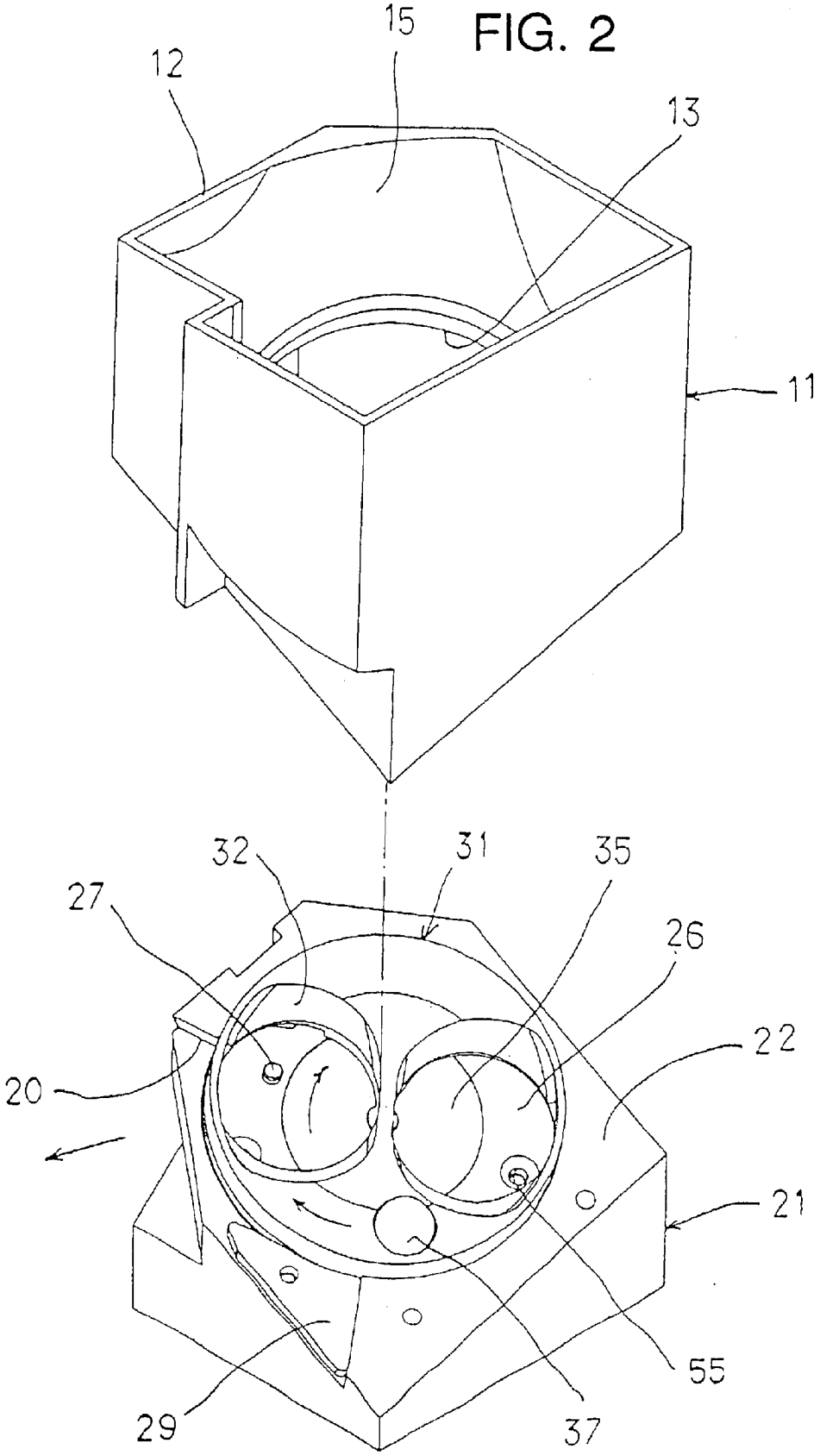
FIG. 2 is an exploded view of the embodiment according to FIG. 1.

The container or head 11 has a slope plane 15 formed above the inside of whole bottom opening surface 13. When this container 11 is removed, a synthetic resin molded base 21 shaped as a tilted trapezoidal is exposed as shown in FIG. 2. This hollow base 21 has a prismatic shape. The hollow base 21 has an upper surface formed in an extensive oblique base plane 22. At the center of the base plane 22, a large circular indent surface 23 is formed, as shown on FIG. 3. The indent surface 23 partially delimits a large metallic ring surface 26. The ring surface 26 forms a sliding surface for the coins.

An exit 20 for the coins is formed at a part of base plane 22 which is surrounding this ring 26. This is an interruption of the indent surface 23. A guide pin 27 for releasing the coin is placed near the coin exit 20. The guide pin 27 is positioned to project at the inside margin of ring 26 for a spring (not shown). A part of the base plane 22 which forms the coin exit 20 is formed by means of metallic adjustment board 29. This triangular adjustment board 29 is fixed by a screw and can be changed, when the coin size/type is changed. An appropriate adjustment board 29 may be replaced with an new appropriate adjustment board 29 to change the size/type of the coin. At the central portion of indent surface 23, a hole 25 is provided. The hole receives penetrating rotating shaft 36 shown in FIG. 5.

Figure 3:
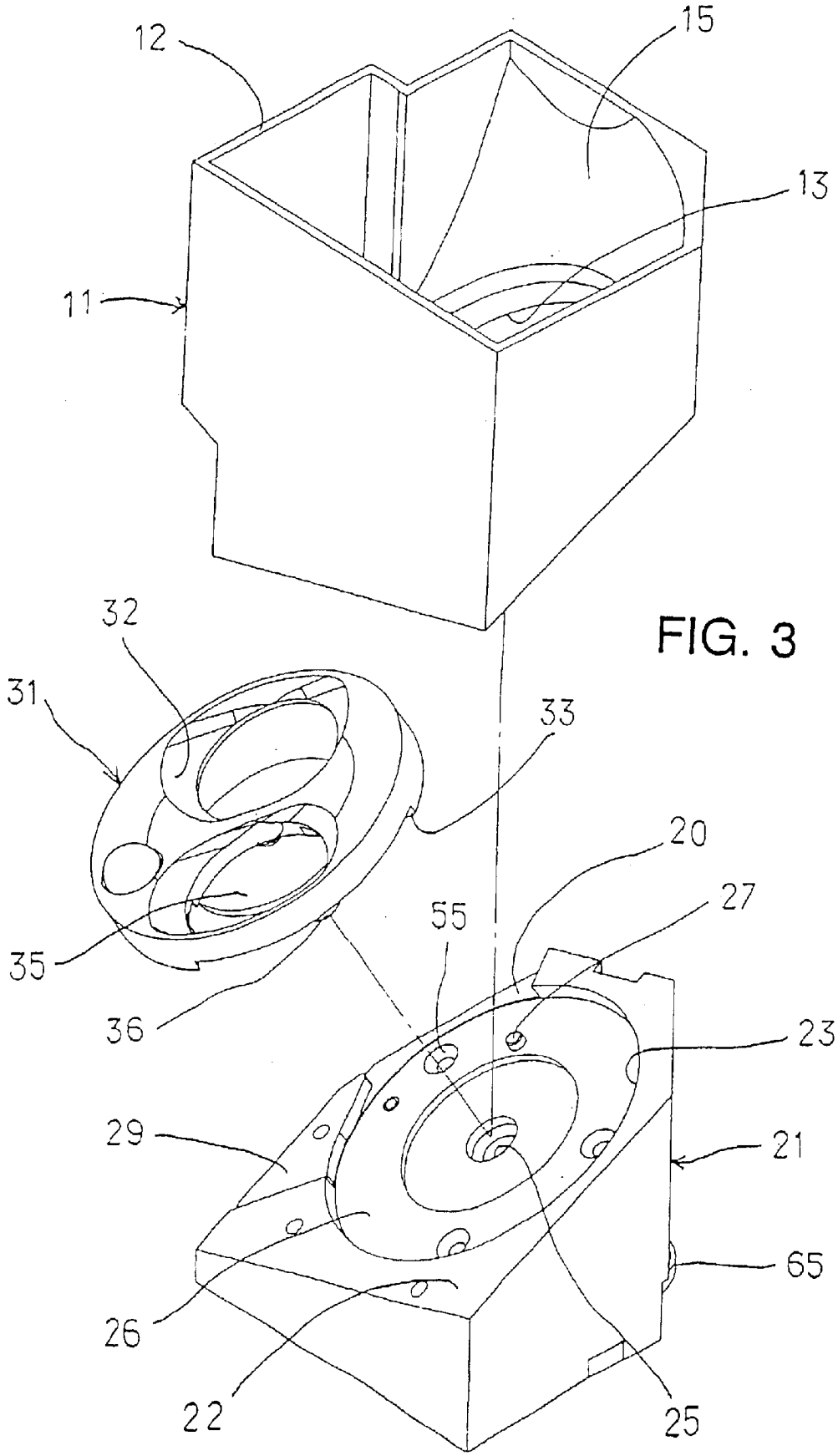
FIG. 3 is an exploded view of the embodiment according to FIG. 1 further exploded as compared with the showing of FIG. 2.

At the center of FIG. 3 a disk 31 is shown for dispensing the coins within head 11 one by one. The disk 31 is provided to rotate freely. The disk 31 includes a metallic thick disk, for example. To each side (right and left in FIG. 5) of the rotation axis 30 of disk 31, open holes 32 are respectively formed. Each open hole 32 has opening surfaces which taper. Thus, each coin falls into each open hole 32 evenly and is prepared for the coin issuance. The entire upper surface of disk 31 is formed for as a sloping surface, provided in the embodiment shown as slightly concave.

Figure 5:
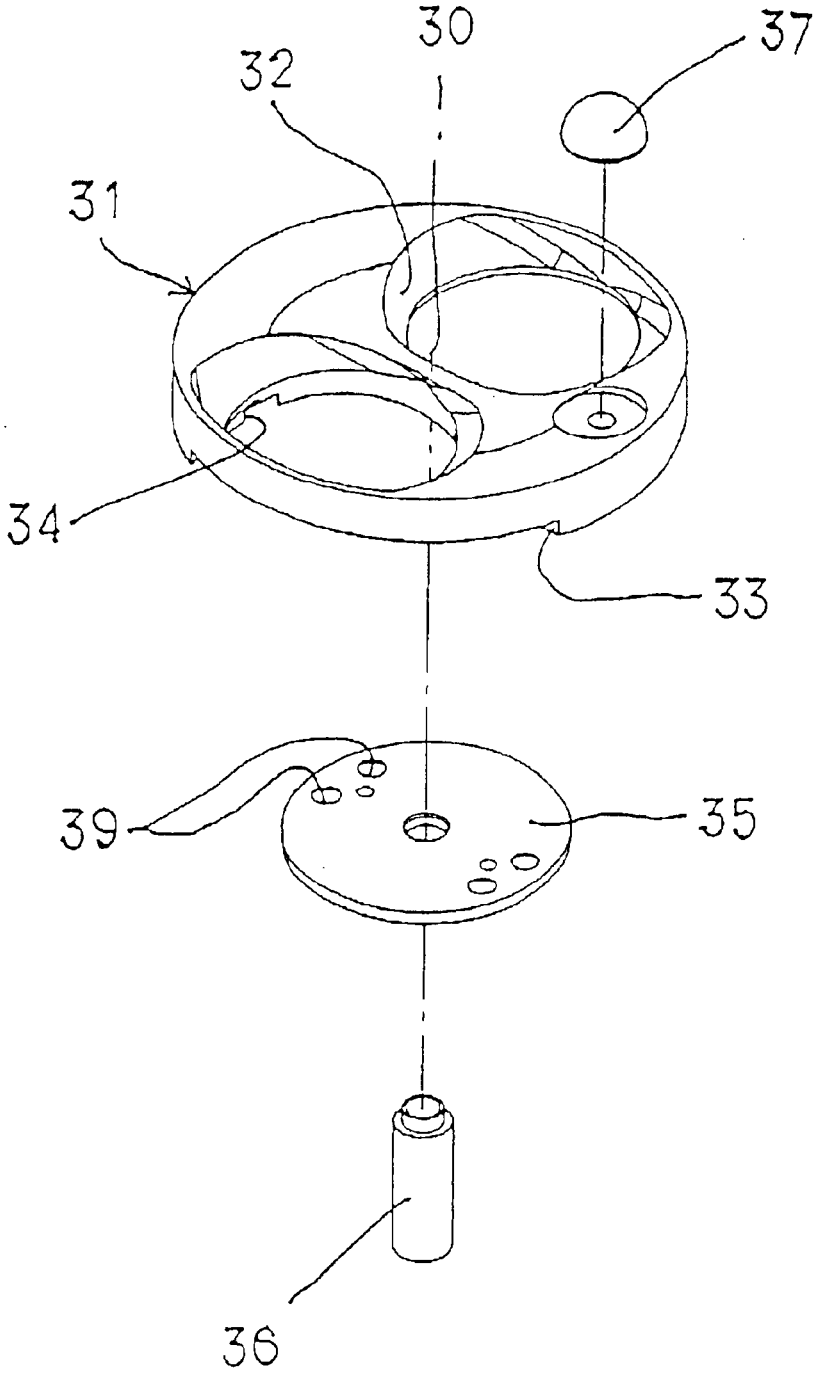
FIG. 5 is an exploded perspective view which of the disk arrangement of FIG. 4.

On the underside of disk 31 two projection divisions 33 are formed for issuing the coin (see FIG. 5). Each projection division 33 is formed so that it may act appropriately corresponding to each open hole 32, respectively. Further, on projection division 33, arc grooves 34 are provided for passing through the guide pin 27 (see FIG. 2). A small circular and metallic axial plate 35, which is shown at the lower part on FIG. 5, is fit into ring 26 and rotated-freely.

A short and metallic rotating shaft 36, which is shown at the most-lower part in FIG. 5, is fixed into the center hole of axial plate 35, by means of staking, etc. The axial plate 35 is fixed on the underside of disk 31 by screws (not shown) via existing screw holes 39 shown in FIG. 5. A small hemispherical protrusion 37 is provided on the upper surface of disk 31 for stirring the coins. The protrusion 37 is fixed on disk 31, for example, by a screw portion (not shown).

Figure 6:
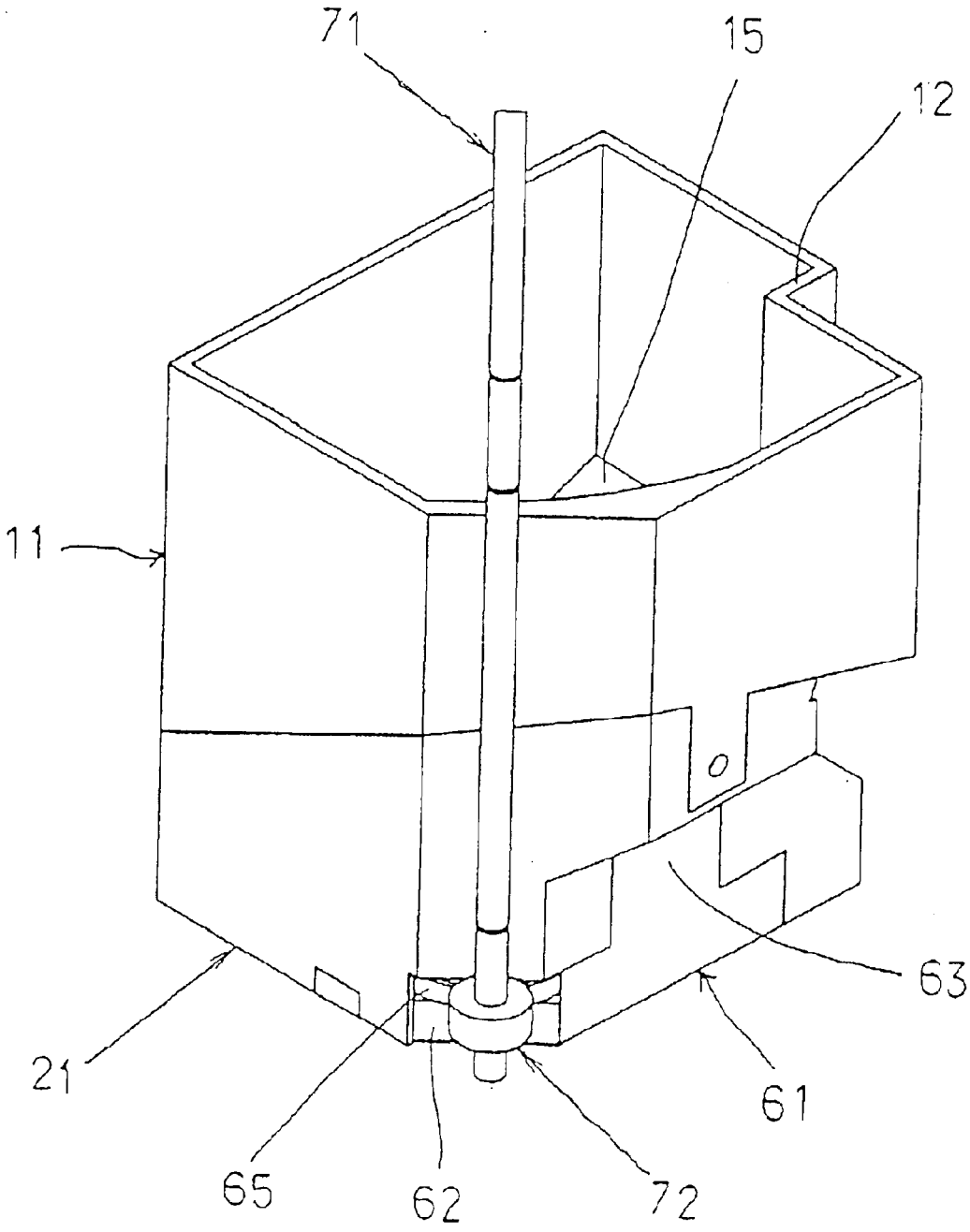
FIG. 6 is a perspective view showing a drive arrangement of an embodiment according to the invention.
Figure 9:
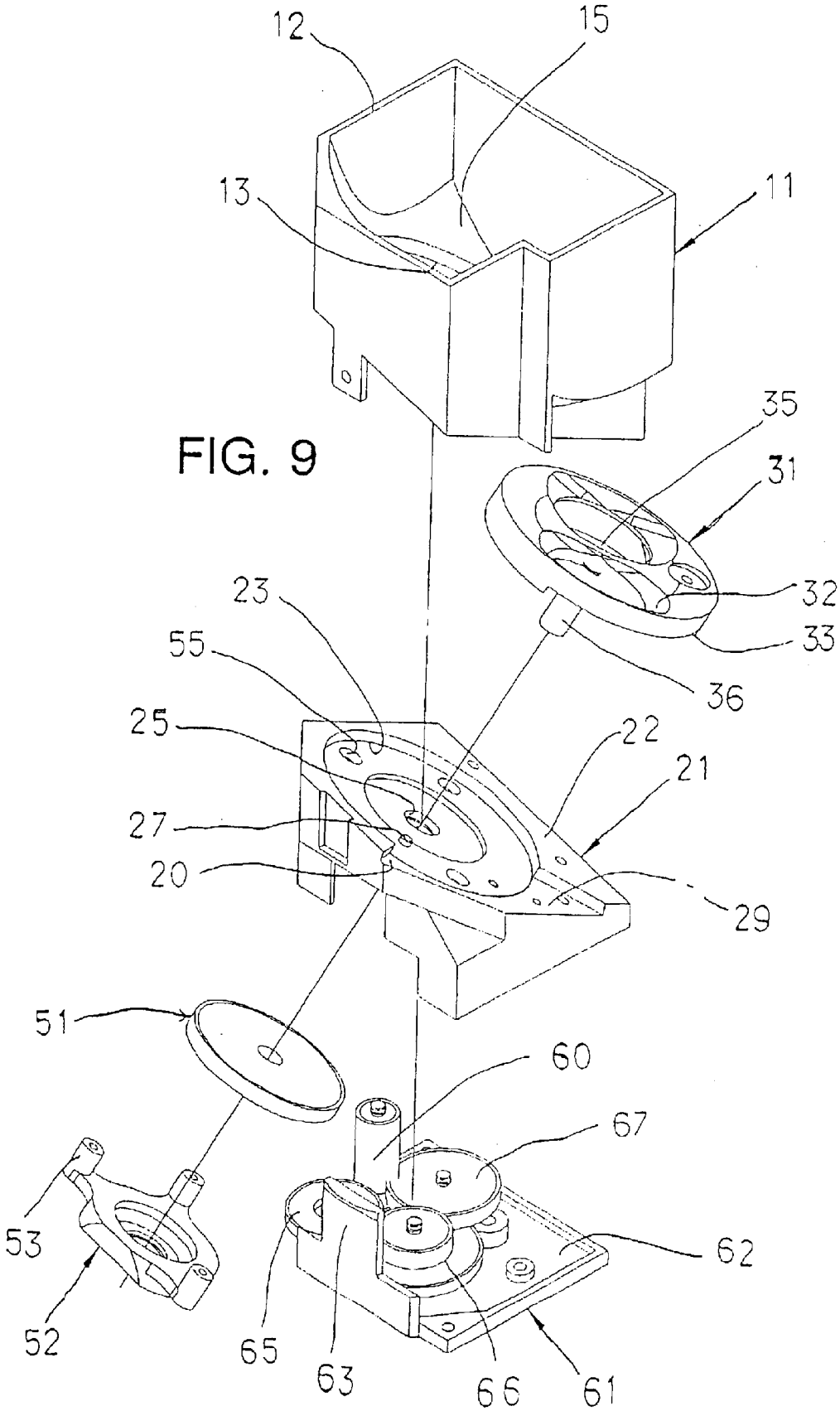
FIG. 9 is a perspective exploded view showing the embodiment of FIG. 3 further.
Figure 10:
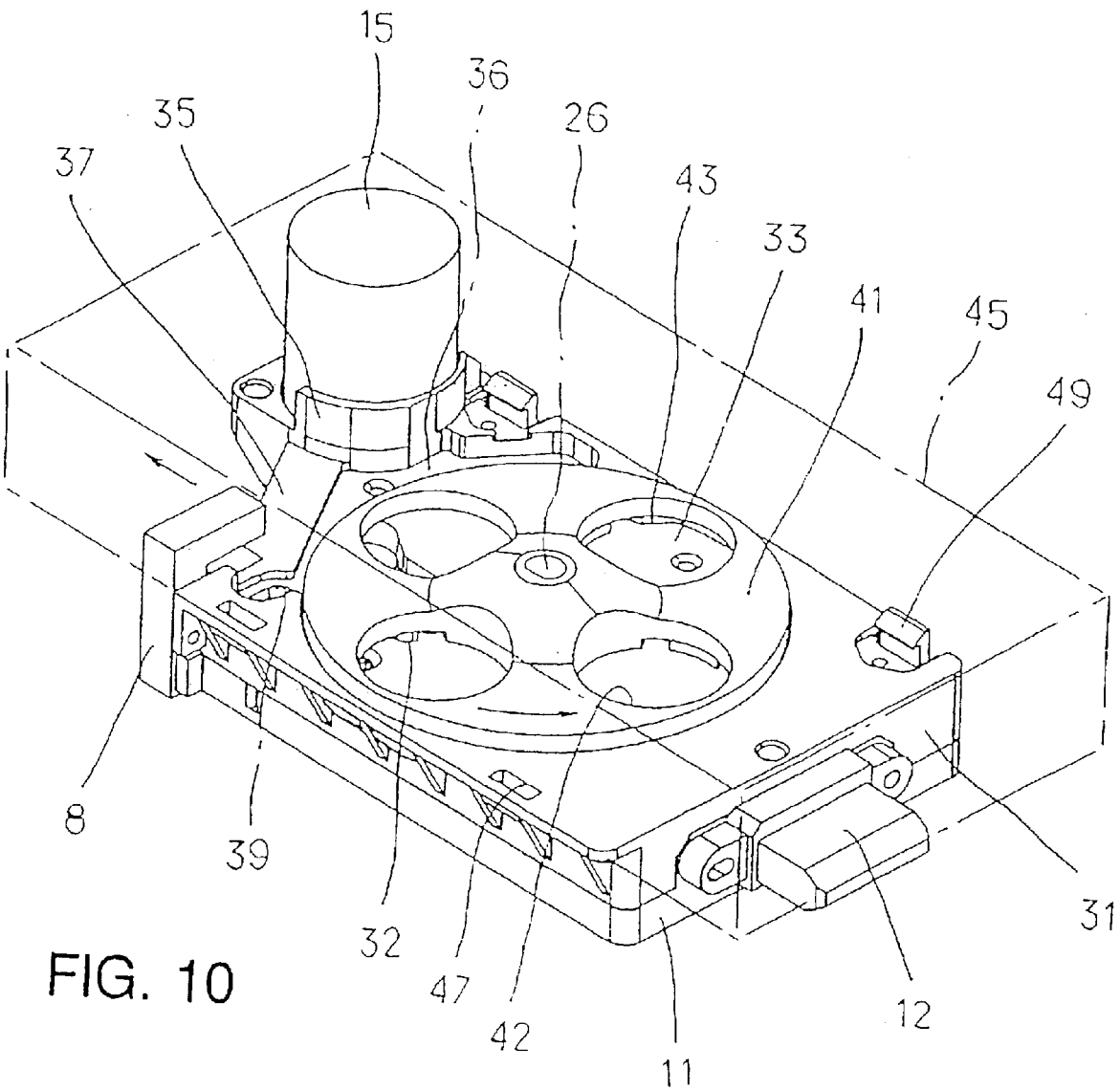
FIG. 10 is a perspective view of a known coin hopper.
Figure 11:
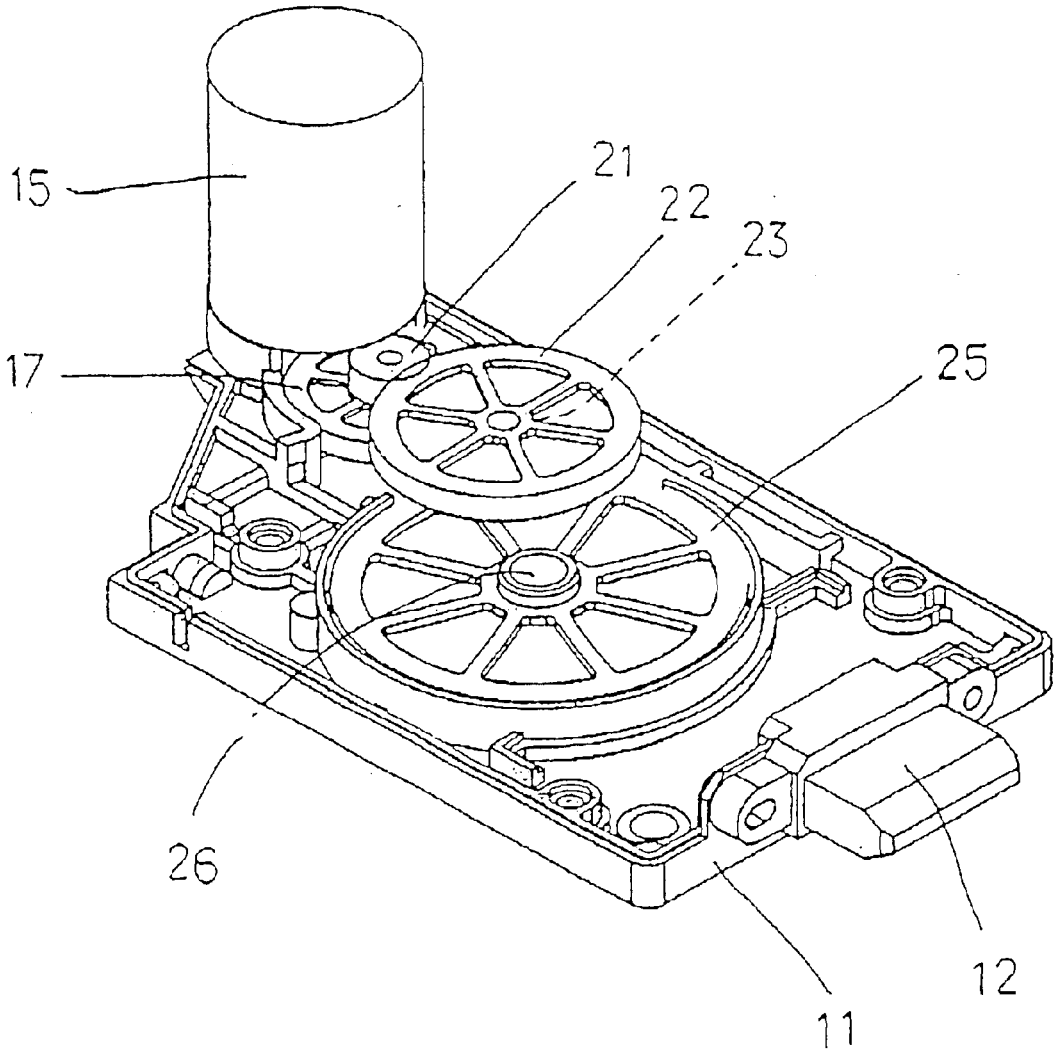
FIG. 11 is a summary perspective view of the coin hopper shown in FIG. 10 after removing the upper part thereof.

FIG. 6 is a perspective view which summarily shows a drive connection or drive arrangement of an embodiment according to the invention. The disk 31 that is freely rotatable installed on base 21 as shown in FIG. 9. The rotating shaft 36 of disk 31 is freely rotatable and penetrates into the hole 25 at the center of indent surface 23 on base 21. On the tip of rotating shaft 36 which is penetrated into hole 25, a helical gear 51 is disposed and fixed. Further, at the tip of rotating shaft 36 that penetrates through helical gear 51, a bearing 52 with summarized Y-shape is disposed.

Each of three support tips 53 of bearing 52 is fixed on the back or lower surface of base plane 22. The bearing 52 freely rotatable retains the rotating shaft 36. More particularly, each of the support tips 53 of the bearing 52 is fixed by means of screw holes 55 (see FIG. 3) of ring 26 and screws (not shown).

An assembly with a rectangular base, which is shown at the lower part of FIGS. 9, is provided with a bottom base 61. This bottom base 61 has a base plate portion 62 and a standing portion 63 provided for connection. These portions 62 and 63 are synthetic resin molded products. The bottom base 61 is fixed by screws (not shown) in order to close the bottom opening of base 21 (see FIG. 9).

Figure 7:
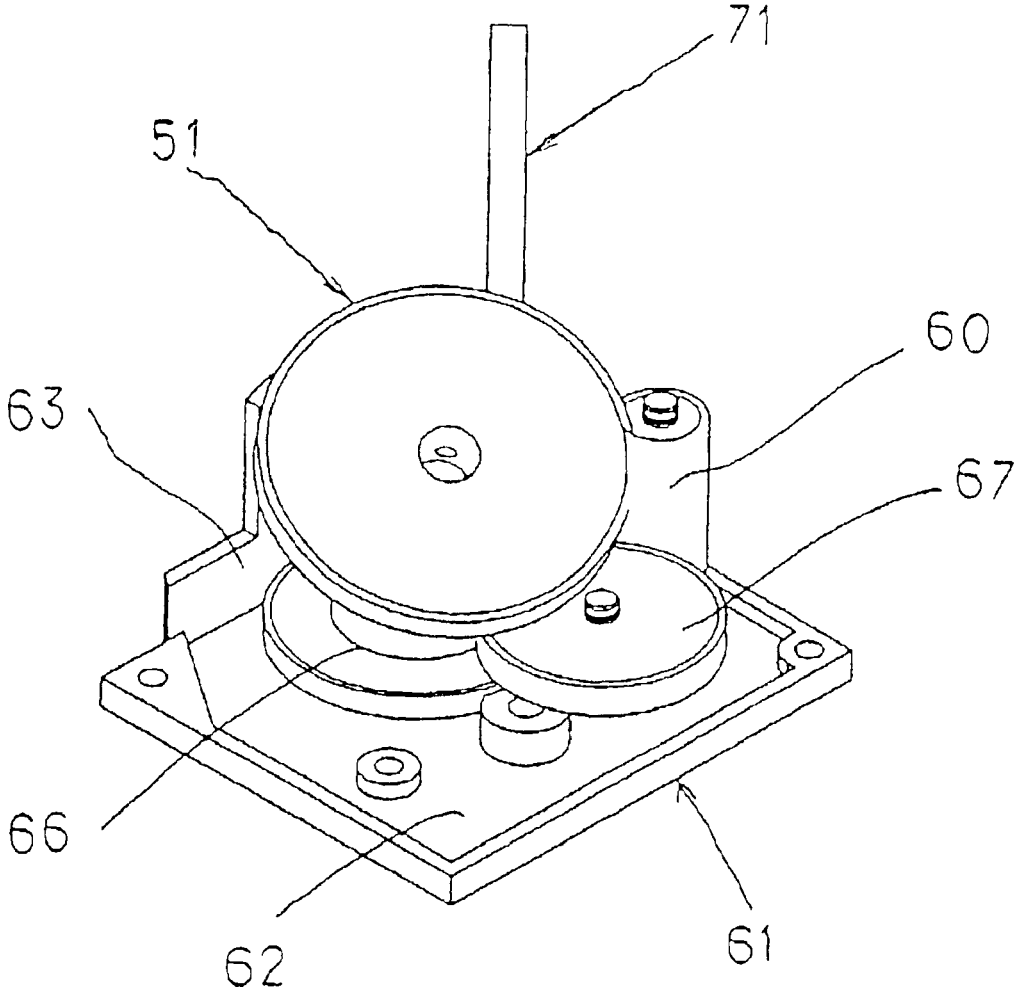
FIG. 7 is a perspective view showing the drive arrangement of FIG. 6 with an upper part removed.
Figure 8:
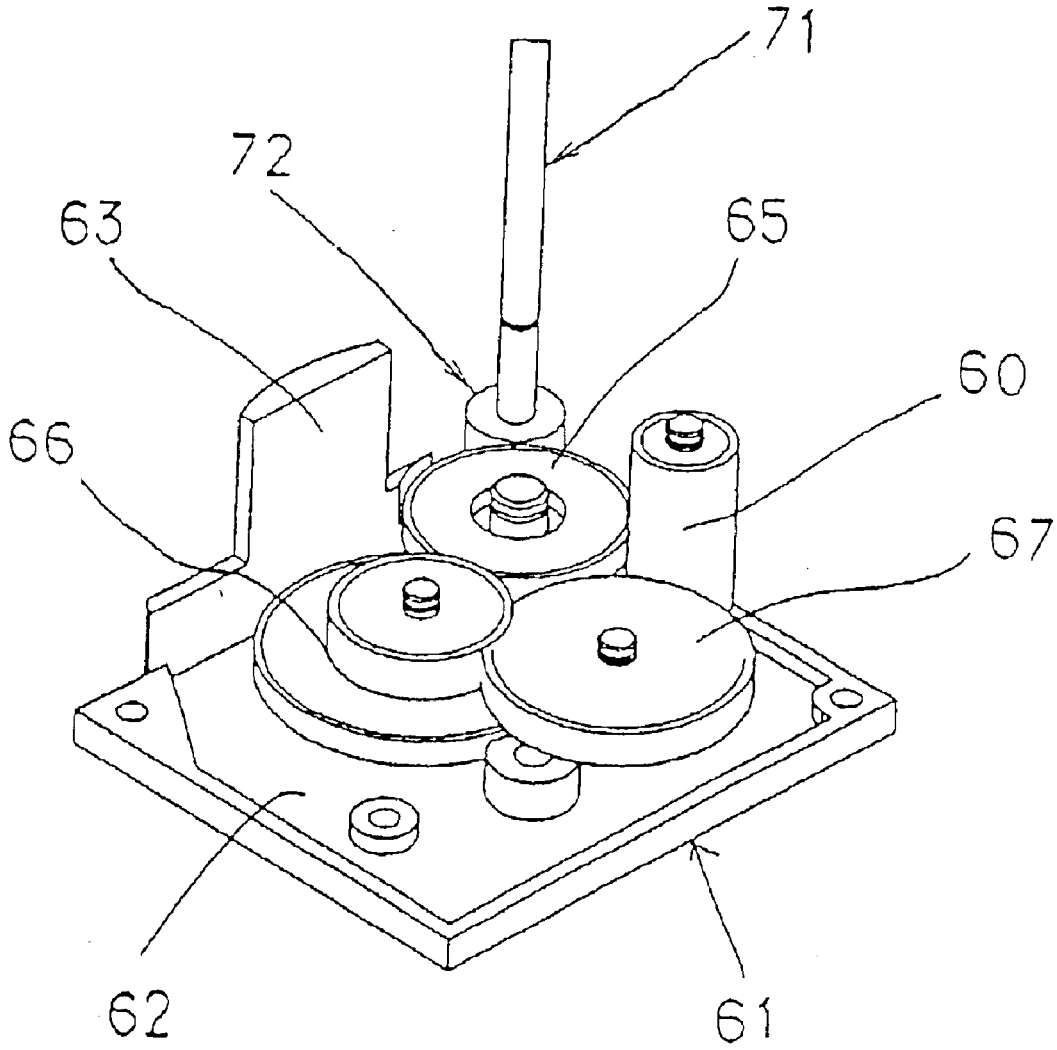
FIG. 8 is a perspective view showing a part of the drive arrangement with a further part removed.

A shaft gear 60, which engages with a helical gear 51, extends up at the edge part of base plate portion 62 and is mounted freely rotatable as seen in FIG. 7. At the corner of base plate portion 62 between this shaft gear 60 and standing portion 63, a stepped spur gear 65 is freely rotatably arranged. In addition, a stepped gear 66 is arranged extending in a level manner and freely rotatable, nearly at the center of base plate portion 62. The small gear under stepped spur gear 65 and the large gear under stepped gear 66 are engaged together as shown in FIG. 8. Near the stepped gear 66 at the center of base plate portion 62, a spur gear 67 is disposed and freely rotatably arranged.

The spur gear 67 engages with the small gear on stepped gear 66. A part of the stepped spur gear 65 which is arranged on the corner of base plate portion 62 protrudes therefrom as shown in FIG. 6. That is, a part of stepped spur gear 65 protrudes at the bottom corner portion of the coin hopper.

This embodiment described above is used, as shown on FIG. 6, for example, with a small drive gear 72 fixed at the lower part of a long drive axis 71. The small drive gear 72 engages the stepped spur gear 65 and the small drive gear 72 rotates the stepped spur gear 65.

When stepped the spur gear 65 is rotated, shaft gear 60 is rotated by intervening with stepped gear 66 and spur gear 67 as shown in FIG. 8. When shaft gear 60 is rotated, helical gear 51 is rotated (see FIG. 7). When helical gear 51 is rotated, disk 31 is rotated (see FIG. 9). As disk 31 rotates, the coins (not shown) with in the open holes 32 are discharged to the exit 20 (see FIG. 2). That is, the coins which fell into open holes 32 are pushed to the direction of exit 20, by means of projection part 33. The coin which is pushed by projection part 33 of disk 31 is discharged from exit 20, by means of guide pin 27.

As two open holes 32 are provided in the practical example, one hole is filled with a coin while the coin remains in the other hole. Only one open hole 32 may be formed in disk 31.

Figure 12:
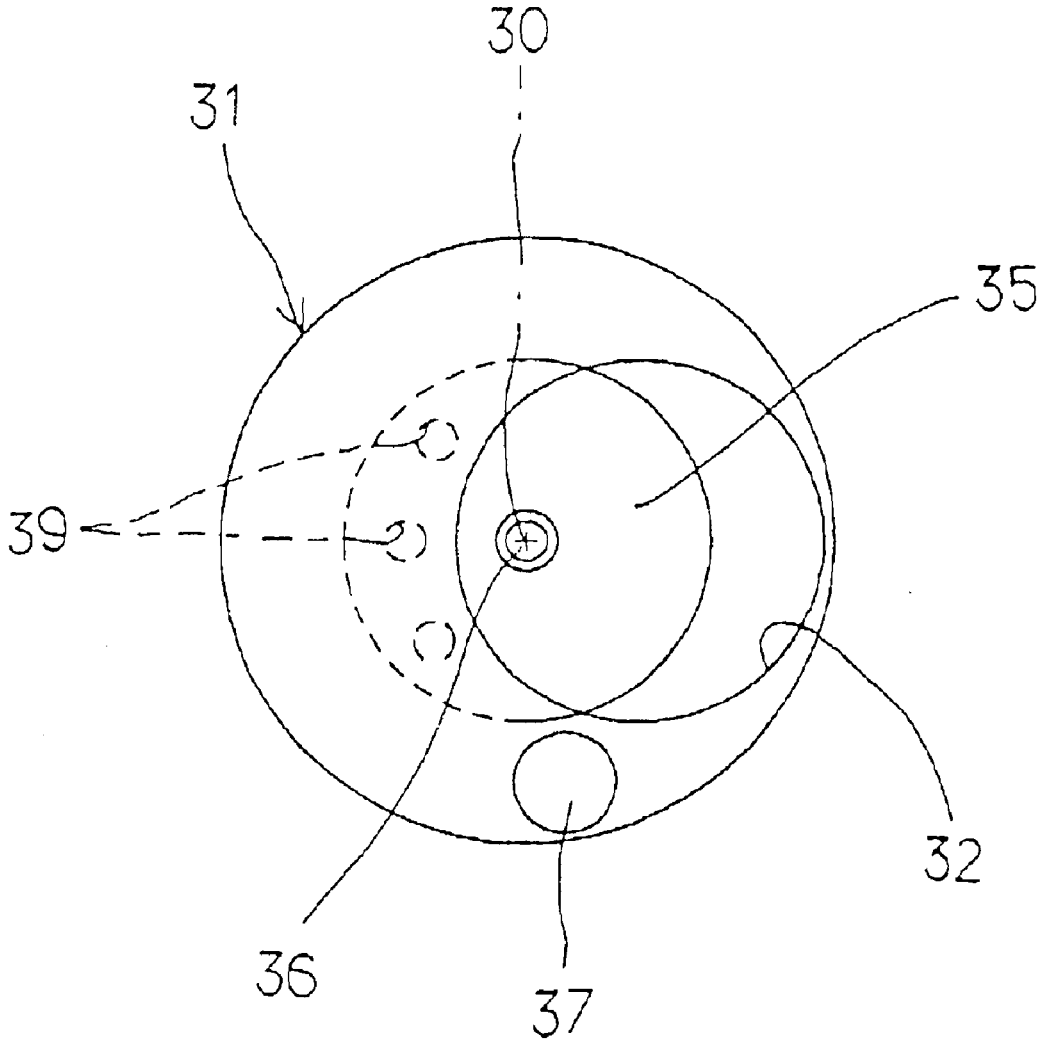
FIG. 12 is a plan view showing another embodiment according to the invention.

As an example of this another embodiment of the invention is provided with the structure as discussed above wherein as disk 31 as shown in FIG. 12 is used. The disk 31 of FIG. 12 has only one open hole 32. This single opening 32 in disk 31 is formed extending beyond the rotation axes 30 of disk 31. The open hole 32 has a taper at the opening edge so that the coins may fall evenly (not shown). The projection division 33 is formed for issuing the coins, at the underside of disk 31. A hollow groove 34 is formed at the projection division 33, for passing the guide pin 27. The circular, small and metallic axial plate 35 is freely rotatable fit into the ring 26. The short and metallic rotating shaft 36 is fixed into the center hole of axial plate 35, by means of staking and so on. The axial plate 35 is fixed on the underside of disk 31 by screws (not shown) using existing screw holes 39.

Still, the small hemispherical protrusion 37 on the upper surface of disk 31 is for stirring the coins. The protrusion 37 is fixed on the disk 31, for example, by a screw connection (not shown). Also, though two open holes 32 were made in the practical example, it is of course possible for three and more open holes 32 to be formed. In this case, though the illustration was omitted, three and more open holes 32 may be formed to be at regular intervals around the rotation axis 30 of disk 31. Also, disk 31 is manufactured from metallic thick plate in the practical example. The disk 31 may be made of worked sheet metal or the like. The disk 31 may be made from a synthetic resin molded product and the abrasion position may be covered with a metallic thin plate. Though gears of the practical example are made as synthetic resin molded products, it is of course possible to make the gears from a metallic thin sheet.

As described above, this invention provides the ability to decrease the number of open holes for coin acceptance of the disk for coin emission. The effect of this is a simplified structure for a coin hopper and a miniaturization of the dimensions of the coin hopper. The invention presents the advantage that the size of the whole coin hopper can be very much reduced.

While specific embodiments of the invention have been shown and described in detail to illustrate the application of the principles of the invention, it will be understood that the invention may be embodied otherwise without departing from such principles.

What is claimed is:

1. A coin hopper comprising:

a substantially cylindrical container for storing a plurality of coins in a bulk condition;

a support with a coin exit;

a disk supported by said support and mounted freely rotatably within a bottom of said container, said disk having only one opening for accepting coins and releasing coins to said coin exit, said coin hopper further comprising:

a shaft supported for rotation by said support; and a plate, said disk being connected to said shaft by said plate.

2. A coin hopper comprising:

a substantially cylindrical container for storing a plurality of coins in a bulk condition;

a base;

a disk with a disk portion and a central axle portion and a connection, said axle portion having a rotational axis and an axle portion radial extent, said axle portion being mounted freely rotatably on said base, said disk portion having a disk surface within a bottom of said container with said disk portion having a coin passage opening extending from said disk surface through said disk portion, said coin passage opening having an extent at said disk surface that is overlying said axle portion radial extent.

3. The coin hopper as described in claim 2, wherein said disk portion comprises a disk member, said axle potion comprises an axle shaft and said connection comprises an axle plate connected on one side to said axle shaft and connected on an opposite side to said disk member.

4. The coin hopper as described in claim 3, wherein said connection of said axle plate to said disk member is spaced radially from a center of rotation of said axle shaft.

5. The coin hopper as described in claim 3, wherein two openings are formed in said disk portion.

6. The coin hopper as described in claim 3, wherein two openings are formed in said disk portion and said connection of said axle plate to said disk member is spaced radially from a center of rotation of said axle shaft.

7. The coin hopper as described in claim 5, wherein said two openings are closed with respect to each other.

8. A coin hopper comprising:

a coin container for holding coins in a bulk condition;

a base;

a gear mechanism with gears in said base for transmitting a rotational drive in response to a mechanical input;

a shaft connected to said gear mechanism;

a feed disk with a coin passage opening, said feed disk being connected to said shaft for rotation of said feed disk at the bottom of said container, said feed disk having a diameter that in not more than 2.5 times a diameter of said coin passage opening, wherein said coin passage opening extends from an upper disk surface in said container to an upper surface of said base in an axial direction and has a slot in a peripheral surface of said disk for issuance of a coin in a radial direction of said feed disk.

9. A coin hopper in accordance with claim 8, wherein said gear mechanism has an input outside of said base for connection to a mechanical input external to the base.

* * * * *